US007037134B2

(12) United States Patent
Rubenstein et al.

(10) Patent No.: US 7,037,134 B2
(45) Date of Patent: May 2, 2006

(54) INTERCONNECT SYSTEM HAVING HOUSING ASSEMBLY WITH PIN RECEPTOR

(75) Inventors: Brandon Aaron Rubenstein, Loveland, CO (US); William Youngman, Rocklin, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/851,373

(22) Filed: May 21, 2004

(65) Prior Publication Data

US 2005/0260891 A1 Nov. 24, 2005

(51) Int. Cl.
*H01R 13/648* (2006.01)

(52) U.S. Cl. ..... 439/607; 439/98

(58) Field of Classification Search ..... 439/607, 439/95, 98, 579

See application file for complete search history.

(56) References Cited

U.S. PATENT DOCUMENTS

| | | | | |
|---|---|---|---|---|
| 4,889,500 | A * | 12/1989 | Lazar et al. | 439/579 |
| 5,194,020 | A | 3/1993 | Voltz | 439/579 |
| 5,876,248 | A | 3/1999 | Brunker et al. | |
| 5,879,173 | A | 3/1999 | Poplawski et al. | 439/138 |
| 5,913,690 | A * | 6/1999 | Dechelette et al. | 439/108 |
| 6,227,882 | B1 | 5/2001 | Ortega et al. | 439/101 |
| 6,267,606 | B1 | 7/2001 | Poplawski et al. | 439/92 |
| 6,358,062 | B1 | 3/2002 | Feldman | 439/63 |
| 6,402,565 | B1 | 6/2002 | Pooley et al. | 439/680 |
| 6,535,397 | B1 | 3/2003 | Clark et al. | 361/788 |
| 6,551,117 | B1 | 4/2003 | Poplawski et al. | 439/92 |
| 6,595,801 | B1 * | 7/2003 | Gardner et al. | 439/607 |
| 6,623,279 | B1 | 9/2003 | Derian et al. | 439/74 |

* cited by examiner

*Primary Examiner*—Hae Moon Hyeon

(57) ABSTRACT

An interconnect system is described herein. The interconnect system includes a module having a signal device and a ground substantially surrounding the signal device; a cable having a cable shielding to electrically couple with the ground, and a cable signal line disposed within the cable shielding to electrically couple with the signal device; and a housing assembly interposed between the module and the cable. The housing assembly includes: (a) an inner housing signal line that electrically couples the cable signal line of the cable with the signal device; and (b) a conductive housing that electrically couples the cable shielding with the ground. The conductive housing substantially surrounds and electrically shields the inner housing signal line. The signal device includes a plurality of signal pins, and the plurality of signal pins electrically couple with a pin receptor of the inner housing signal line of the housing assembly.

15 Claims, 3 Drawing Sheets

INTERCONNECT SYSTEM HAVING HOUSING ASSEMBLY WITH PIN RECEPTOR

BACKGROUND

Interconnect designs have exhibited electromagnetic interference (EMI) or noise. Attempts to reduce the amount of EMI have resulted in bulky designs. It is difficult to reduce the size of interconnect devices while minimizing EMI or noise, and while maintaining performance and efficiency.

BRIEF DESCRIPTION OF DRAWING FIGURES

DETAILED DESCRIPTION

Figure 1:
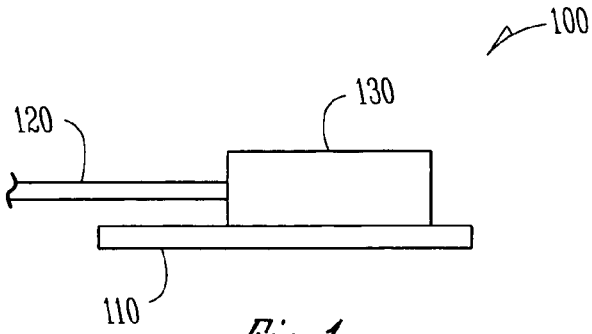
FIG. 1 illustrates an interconnect system according to an embodiment.

FIG. 1 illustrates an interconnect system 100 according to an embodiment. The interconnect system 100 includes an electronic module 110, a cable 120, and an interconnect 130 electrically coupling the electronic module 110 and the cable 120. The interconnect 130 facilitates a signal path, between the cable 120 and the module 110, being substantially shielded by a ground path, between the cable 120 and the module 110, as discussed in more detail later. In an embodiment, the electronic module 110 is a grounded board, for example, one of a motherboard and a printed circuit board. In an embodiment, the interconnect 130 minimizes electromagnetic interference in the system 100.

Figure 2:
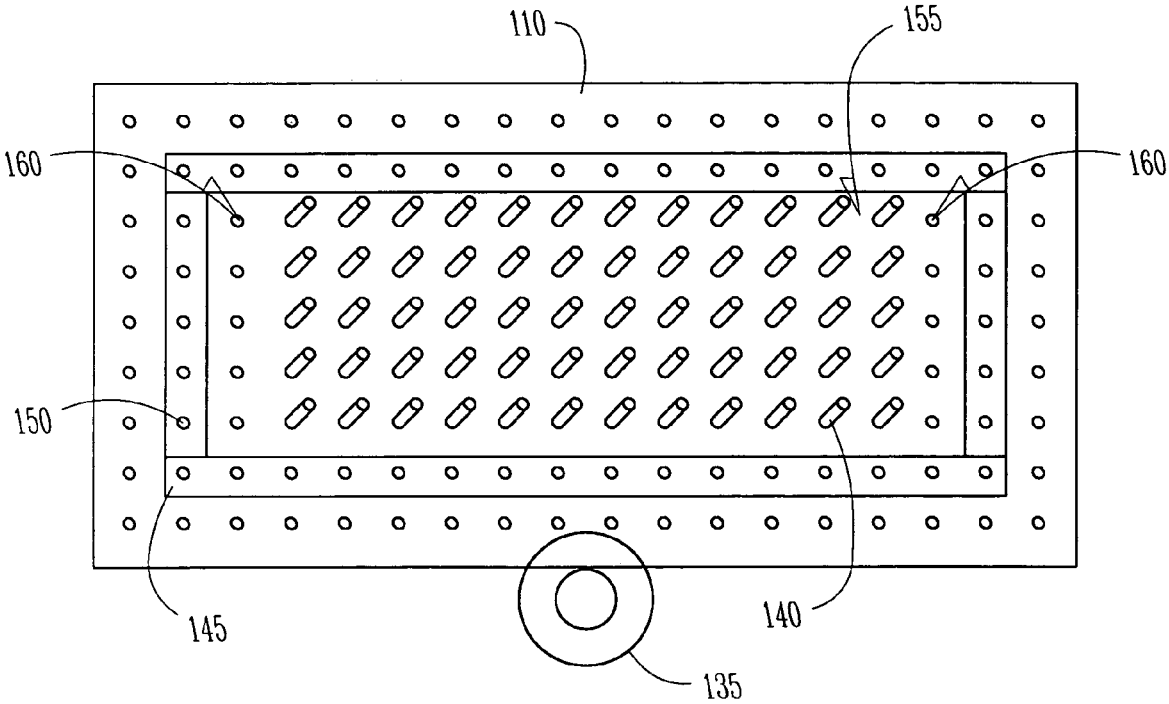
FIG. 2 is a plan view of a module according to an embodiment.

FIG. 2 is a plan view of the module 110 according to an embodiment. In an embodiment, the module 110 has a tower coupler 135, a signal device 140 and at least one ground 145. In an embodiment, the ground grounds an electrical signal. In an embodiment, the ground 145 in the module 110 includes a plurality of ground pins 150 that substantially surrounds the signal device 140. In an embodiment, the signal device is any device that facilitates transmission of an electrical signal. In an embodiment, the signal device 140 includes at least one signal pin. In an embodiment, the signal device includes a signal pin array 155.

In an embodiment, the signal pin array 155 is rectangular. However, the arrangement of signal pins may be any shape. In an embodiment, a ground pin column 160 is adjacent each transverse side of the array 155. In an embodiment, there is a first ground pin column 160 of five ground pins 160, a second ground pin column of five ground pins 160, and a twelve by five array 155 of signal pins in between the two ground pin columns 160. In this embodiment, the first and second ground pin columns 160 are adjacent the signal pin array 155, at opposite ends of the array. In another embodiment, the signal pin array 155 can have any number of rows and columns for signal pins. In another embodiment, the ground pin column 160 is adjacent each longitudinal side of the array 155. In an embodiment, the ground pins of the ground pin column 160 correspond in number to the signal pins in the side of the array 155 to which the column 160 is adjacent. In another embodiment, there are no ground pin columns 160.

In an embodiment, the plurality of ground pins 150 substantially surrounds the signal pin array 155 and the ground pin columns 160. In an embodiment, the plurality of ground pins 150 electrically couple with the ground path of the interconnect 130 and the cable 120. The plurality of ground pins 150 are outlined in FIG. 2 by a thick-line for clarity.

In an embodiment, the signal device 140 electrically couples with the electrical signals or power in the interconnect 130 and in the cable 120. In an embodiment the signal device 140 extends a greater distance from the module 110 as compared with extension of the ground 145 from the module. In an embodiment, the signal pins in the array 155 are about 10 mm long, and the ground pins are about 2 mm long. In an embodiment, the signal pins of the array 155 have about the same diameter as compared with the ground pins 150. In an embodiment, the diameter is less than about 1 mm.

Figure 3:
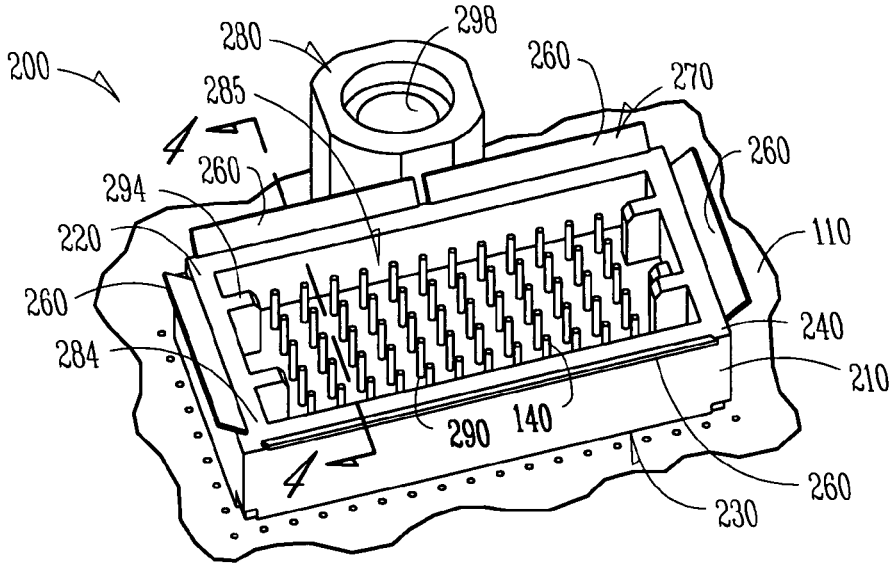
FIG. 3 is a shroud assembly on the module of FIG. 2 according to an embodiment.
Figure 4:
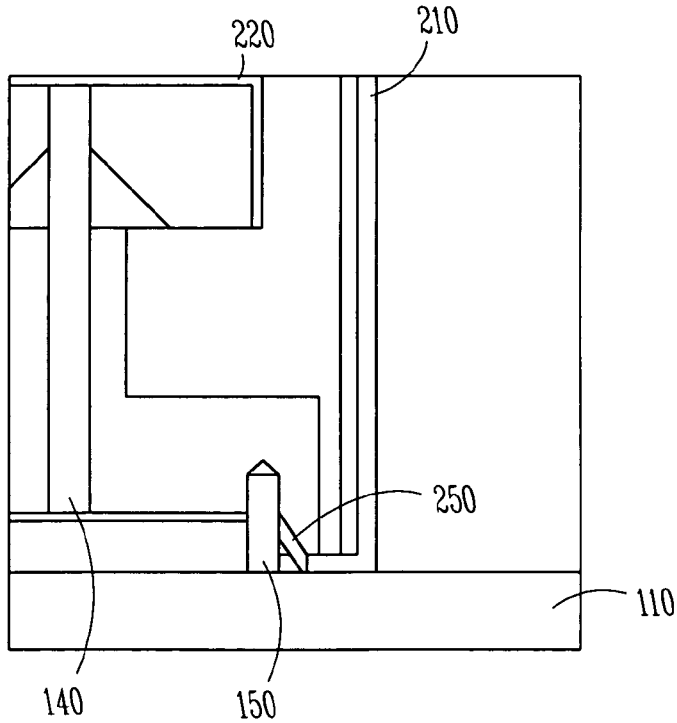
FIG. 4 is a cross-sectional view taken through section 4—4 in FIG. 3 according to an embodiment.

FIG. 3 is a shroud assembly 200 on the module 110 of FIG. 2 according to an embodiment. FIG. 4 is a cross-sectional view taken through section 4—4 in FIG. 3 according to an embodiment. The shroud assembly 200 includes a skirt 210 to electrically couple with the ground 145 (not shown), and a shroud 220 receiving the signal device 140.

In an embodiment, the skirt 210 is electrically conductive, and at least partially formed of an electrically conductive material, such as a metal. In an embodiment, the skirt 210 forms a section of a ground path from the module 110 to the cable 120 to substantially shield a signal path. In an embodiment, the skirt 210 encloses the shroud in a ground path shielding extending a coaxial style shield from the cable to the module. In an embodiment, the skirt 210 continues an encompassing ground path from the cable 120/330 through to the module 110. In an embodiment, the skirt 210 is a means for substantially shielding the signal path with the ground path.

Figure 5:
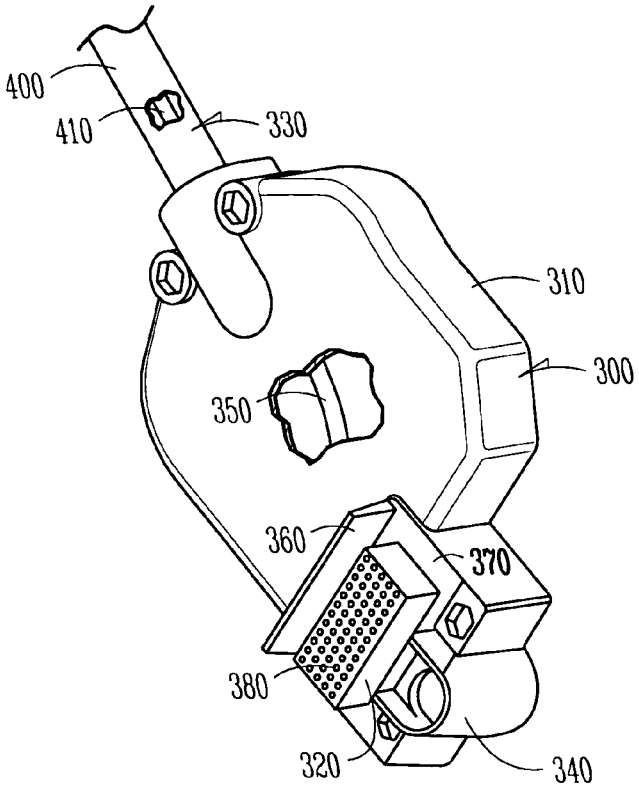
FIG. 5 is a housing assembly according to an embodiment.

In an embodiment, the skirt has a module section 230 with a connector to connect the skirt with the module, and a housing section 240 with a connector to connect the skirt with a housing assembly of FIG. 5. In an embodiment, the connector to connect to the module includes at least one module flap 250 along the module section. In a particular embodiment, the at least one module flap 250 includes a plurality of inwardly-directed flaps (shown in the cross-sectional view of FIG. 4). In an embodiment, the connector to connect to the housing assembly includes at least one housing flap 260 along the housing section. In a particular embodiment, the at least one housing flap 260 includes a plurality of outwardly-directed flaps (shown in FIG. 3). In an embodiment, the connector to connect to the module, and the connector to connect to the housing assembly may be any type of connector that electrically couples while substantially electrically shielding the signal path. In an embodiment, the connector is a surface of the module and/or housing sections.

In an embodiment, the module flap 250 electrically couple with at least one ground pin 150, as shown in the cross-sectional view of FIG. 4. In an embodiment, the module flap 250 allows for tolerance in both a ground pin length and a ground pin diameter due to the flap's 250 flexibility, thickness, material property, height, and width.

In an embodiment, the module flap 250 extends at least partially along an exterior edge of the module section of the skirt, and the housing flap 260 extends at least partially along an exterior edge of the housing section of the skirt. In an embodiment, the flaps 250 and 260 extend at least partially along each of the exterior edges of both the module section and the housing section. In an embodiment, the flaps 250 and 260 extend substantially all the way around the exterior edges of the module and housing sections of the skirt. In an embodiment, the inwardly-directed module flaps 250 are angled inwardly with respect to a wall of the skirt to which the flap is coupled, and the outwardly-directed flaps 260 are angled outwardly with respect to a wall of the skirt to which the flap is coupled. However, other arrangements of the flaps are within the scope of this invention. In an embodiment, a flap angle is in a range of about 30 degrees to about 45 degrees with respect to its adjacent wall. In an embodiment, the flaps are at enough of an angle to allow for the spring to deflect against the housing and/or ground pins. However, other angles are within the scope of this invention. In an embodiment, when the module flap 250 comes into contact with the ground pin 150, the angle of the flap 250 may change depending on the pressure applied, and location, diameter, and length of the ground pin. In an embodiment, when the housing flap 260 comes into contact with a housing assembly of FIG. 5, the angle of the flaps 260 may change depending on the pressure applied to electrically couple the shroud assembly and the housing assembly.

In an embodiment, the flaps 250 and 260 are spring-like in that they are flexible and tend to bend under pressure. When the flaps bend, they tend to maximize a contact region with the mating surface. In an embodiment, the inwardly-directed module flaps are angled towards a central region of the shroud 220 to form an angle of less than 90 degrees with its adjacent interior wall of the skirt. In an embodiment, the outwardly-directed housing flaps are angled away from the shroud to form an angle of less than 180 degrees with its adjacent exterior skirt wall. Other angles for the flaps are within the purview of one skilled in the art.

In an embodiment, the shroud 220 is substantially electrically shielded by the skirt 210. In an embodiment, the shroud includes a polymer material. In an embodiment, the shroud includes a glass-filled nylon. The shroud may be formed of any material that is substantially moldable and is substantially rigid and robust. In an embodiment, the shroud is made of the same material as the skirt. In an embodiment, the shroud 220 and the skirt 210 are integral.

In an embodiment, the shroud 220 has a main section 270 and a tower section 280 coupled to the main section 270. In an embodiment, the main section 270 has walls 284 that form a cavity 285 to receive a pin receptor of a housing assembly, as discussed in more detail herein. Along the module section 230 of the main section 270 are a plurality of recesses 290 to receive the signal pins of the array 155. In an embodiment, the plurality of recesses 290 corresponds to the plurality of signal pins of the array 155, in number and/or in size. In an embodiment, the walls 284 of the shroud 220 encompass a greater area than the signal device 140 and/or the columns 160.

In an embodiment, the main section 270 has a plurality of alignment features 294 to facilitate alignment of the plurality of signal pins through the plurality of recesses 290 and to the pin receptor of the housing assembly, as described in more detail with regard to FIG. 5. In an embodiment, the plurality of alignment features 294 are positioned over the two ground pin columns 160 at each end of the array when the plurality of signal pins are received into the plurality of recesses 290 of the shroud 220.

In an embodiment, the tower section 280 facilitates coupling of the shroud assembly 200 to the module 110 and to the housing assembly of FIG. 5. In an embodiment, the tower section 280 has a hole 298 that is threaded for coupling the shroud to the module 110 and to the housing assembly. However, alternative methods of coupling the shroud are within the purview of one skilled in the art.

FIG. 5 is a housing assembly 300 according to an embodiment. The housing assembly 300 has a conductive housing 310, a pin receptor 320, a coupling device to couple with a cable 330 (or cable 120), and a tower coupler 340 to couple with the tower section 280 of the shroud assembly 200.

In an embodiment, the conductive housing 310 is electrically conductive, and at least partially formed of an electrically conductive material. In an embodiment, the conductive housing 310 is metal or metallized material that continues an encompassing ground path from the cable 120/330 through to the module 110. In an embodiment, the conductive housing 310 is a means for substantially shielding the signal path with the ground path.

In an embodiment, the conductive housing 310 encases and electrically shields an inner housing signal line 350. The inner housing signal line 350 forms part of the signal path and is shown in the cut away of the conductive housing 310 in FIG. 5.

In an embodiment, the conductive housing 310 has an extension 360 that facilitates alignment of the shroud 220 with the pin receptor 320 when the pin receptor 320 is to be received into the cavity 285 of the shroud 220. In an embodiment, the alignment features 294 and the inner walls of the shroud guide the pin receptor 320 into the cavity 285 of the shroud to align with the signal pins of the array 155. In an embodiment, the conductive housing 310 has a mating surface 370 adjacent to the pin receptor 320. In an embodiment, the mating surface 370 substantially surrounds the pin receptor 320.

Figure 6:
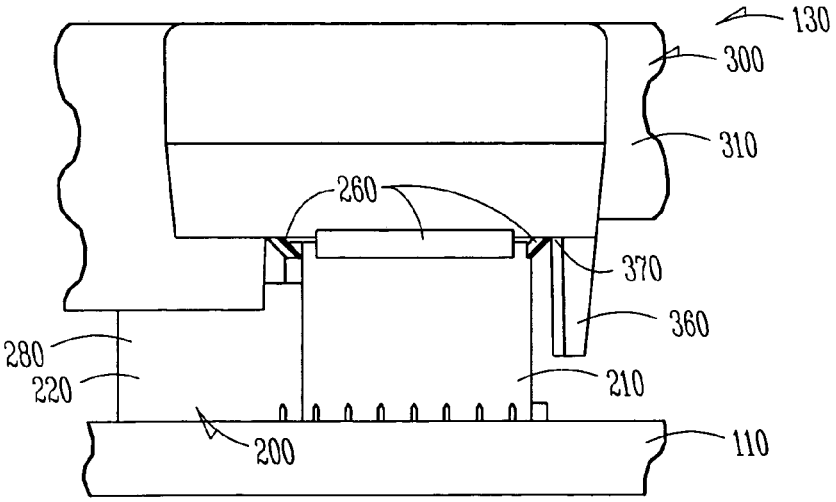
FIG. 6 illustrates a view of the housing assembly of FIG. 5 coupled with the shroud assembly of FIG. 3 according to an embodiment.

In an embodiment, the signal pins of the array 155 are received into corresponding recesses 380 of the pin receptor 320 as the pin receptor 320 is received into the cavity 285 of the shroud 220 as shown in FIG. 6. In an embodiment, the pin receptor 320 is electrically coupled to the inner housing signal line 350.

In an embodiment, the cable 330 has cable shielding 400 to electrically couple with the ground 145, and a cable signal line 410 disposed within the cable shielding 400 to electrically couple with the signal device 140 of the module 110.

The cable signal line 410 forms part of the signal path and is shown in the cut away of the cable in FIG. 5. The cable signal line 410 electrically communicates with the signal device 140 through the inner housing signal line 350, and the pin receptor 320 of the housing assembly 300.

The cable shielding 400 forms part of the ground path. The cable shielding 400 electrically communicates with the ground 145 through the conductive housing 310 of the housing assembly and through the skirt 210. In a more particular embodiment, the ground path substantially surrounds the signal path from the electronic module 110 to the cable 330, wherein the ground path includes the plurality of ground pins 150 electrically coupled to the plurality of inwardly-directed flaps 250 of the skirt, the plurality of outwardly-directed flaps 260 of the skirt electrically coupled to the mating surface 370 of the conductive housing 310, and the conductive housing 310 electrically coupled with the cable shielding 400.

FIG. 6 illustrates a view of the housing assembly 300 of FIG. 5 coupled with the shroud assembly 200 of FIG. 3 according to an embodiment. In an embodiment, the interconnect 130, illustrated in FIG. 1, includes the shroud assembly 200 and the housing assembly 300. In an embodiment, the shroud assembly 200 is disposed between the housing assembly 300 and the module 110 as shown.

In an embodiment, the housing assembly 300 is mechanically and electrically coupled with the shroud assembly 200. In an embodiment, the tower section 280 of the shroud assembly 200 mechanically couples with the tower coupler 340 of the housing assembly 300 and with the tower coupler 135 of the module 110.

In an embodiment, the shroud assembly 200 electrically couples with the housing assembly 300 along the ground path and along the signal path. In an embodiment, the signal path through the shroud assembly 200 is brought together with the signal path through the housing assembly 300 via the pin receptor 320 shown in FIG. 5. In an embodiment, the cavity 285 in the shroud 220 (shown in FIG. 3) receives the pin receptor 320 as the pin receptor receives the signal pins of the array 155 through the recesses 290 in the shroud 220.

In an embodiment, the ground path through the shroud assembly 200 is brought together with the ground path through the housing assembly 300 via the mating surface 370 of the housing assembly 300. As shown in FIG. 6, the housing flap 260 of the skirt electrically couples with the mating surface 370 of the housing assembly 300 to continue the ground path to the conductive housing 310. In an embodiment, the housing flap 260 includes the plurality of outwardly-directed flaps. In an embodiment shown, when pressed against the mating surface 370, the outwardly-directed flaps substantially surrounding the pin receptor bend to maximize a contact region. Thereby, the ground path substantially shields the signal path from the skirt to the housing assembly, in an embodiment.

The elements, materials, geometries, dimensions, and sequence of operations can all be varied to suit particular packaging requirements. Various embodiments also could be used in conjunction with various types of electronic assemblies, such as packages, interposers, printed circuit (PC) boards or other electronic circuit housings and is not meant to be limited to use with boards.

The illustrations of embodiments described herein are intended to provide a general understanding of the structure of various embodiments, and they are not intended to serve as a complete description of all the elements and features of apparatus and systems that might make use of the structures described herein. Applications that may include the apparatus and systems of various embodiments include electronic circuitry used in high-speed computers, communication and signal processing circuitry, modems, processor modules, embedded processors, data switches, and application-specific modules, including multilayer, multi-chip modules. Such apparatus and systems may further be included as sub-components within a variety of electronic systems, such as televisions, cellular telephones, personal computers, personal digital assistants (PDAs), workstations, radios, video players, vehicles, and others.

FIGS. 1 to 6 are merely representational and are not drawn to scale. Certain proportions thereof may be exaggerated, while others may be minimized. Many other embodiments will be apparent to those of skill in the art upon reviewing the above description. Parts of some embodiments may be included in, or substituted for, those of other embodiments.

While the foregoing examples of dimensions and ranges are considered typical, the various embodiments of the invention are not limited to such dimensions or ranges. It is recognized that the trend within industry is to generally reduce device dimensions for the associated cost and performance benefits.

The accompanying drawings that form a part hereof show by way of illustration, and not of limitation, specific embodiments in which the subject matter may be practiced. Embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus the following claims are hereby incorporated into the Detailed Description, with each claim standing on its own as a separate embodiment.

It will be readily understood to those skilled in the art that various other changes in the details, material, and arrangements of the parts and method stages which have been described and illustrated in order to explain the nature of embodiments herein may be made without departing from the principles and scope of embodiments of the invention as expressed in the subjoined claims.

The invention claimed is:

1. An interconnect system comprising:

a module having a signal device and a ground substantially surrounding the signal device, wherein the signal device includes a plurality of signal pins;

a cable having a cable shielding to electrically couple with the ground, and a cable signal line disposed within the cable shielding to electrically couple with the signal device; and a housing assembly interposed between the module and the cable, wherein the housing assembly includes:

(a) an inner housing signal line that electrically couples the cable signal line of the cable with the signal device, wherein the plurality of signal pins electrically couple with a pin receptor of the inner housing signal line of the housing assembly; and (b) a conductive housing that electrically couples the cable shielding with the ground, wherein the conductive housing substantially surrounds and electrically shields the inner housing signal line.

2. The interconnect system of claim 1 further comprising a shroud assembly disposed between the module and the housing assembly, wherein the shroud assembly includes a shroud substantially electrically shielded by a skirt, wherein the skirt electrically couples the ground and the conductive housing, wherein the shroud includes a plurality of recesses to receive the plurality of signal pins.

3. The interconnect system of claim 2 wherein the skirt has a module section adjacent the module, a housing section adjacent the housing, a module flap along the module section, and a housing flap along the housing section.

4. The interconnect system of claim 3 wherein the module flap electrically couples with the ground.

5. The interconnect system of claim 3 wherein the conductive housing has a mating surface adjacent to the pin receptor, wherein the housing flap electrically couples with the mating surface.

6. The interconnect system of claim 5 wherein the mating surface substantially surrounds the pin receptor.

7. The interconnect system of claim 5 wherein a ground path substantially surrounds a signal path from the module to the cable, wherein the ground path includes the ground electrically coupled to the module flap of the skirt, the housing flap of the skirt electrically coupled to the mating surface of the conductive housing, and the conductive housing electrically coupled with the cable shielding.

8. The interconnect system of claim 5 wherein a ground path substantially surrounds a signal path from the module to the cable, wherein the signal path includes the plurality of signal pins received into the pin receptor of the inner housing signal line, and the inner housing signal line electrically coupled to the cable signal line of the cable.

9. The interconnect system of claim 1 wherein the conductive housing is electrically conductive, and at least partially formed of an electrically conductive material.

10. The interconnect system of claim 9 wherein the conductive housing is substantially electrically insulated from the inner housing signal line that carries the signal path.

11. The interconnect system of claim 3 wherein the module flap includes a plurality of inwardly-directed flaps, wherein the ground includes a plurality of ground pins, wherein the plurality of inwardly-directed flaps allows for tolerance in both a ground pin length and a ground pin diameter.

12. The interconnect system of claim 2 wherein the pin receptor is received into a cavity of the shroud as the plurality of signal pins are received into the pin receptor.

13. The interconnect system of claim 12 wherein the ground includes a plurality of ground pins, wherein the plurality of signal pins includes a signal pin array, and the plurality of ground pins substantially surrounds the signal pin array and two ground pin columns at each end of the array.

14. The interconnect system of claim 13 wherein the conductive housing has an extension to facilitate alignment of the shroud with the pin receptor, and wherein the shroud assembly has a plurality of alignment features to align the plurality of signal pins into the pin receptor.

15. The interconnect system of claim 14 wherein the plurality of alignment features are positioned over the two ground pin columns at each end of the array when the plurality of signal pins are received into the plurality of recesses in the shroud.

* * * * *

UNITED STATES PATENT AND TRADEMARK OFFICE

CERTIFICATE OF CORRECTION

PATENT NO. : 7,037,134 B2
APPLICATION NO. : 10/851373
DATED : May 2, 2006
INVENTOR(S) : Brandon Aaron Rubenstein et al.

It is certified that error appears in the above-identified patent and that said Letters Patent is hereby corrected as shown below:

On the face page, in field (56), under "U.S. Patent Documents", in column 2, line 10, delete "Gardner et al." and insert -- Leonard et al. --, therefor.

Signed and Sealed this

Fourteenth Day of April, 2009

JOHN DOLL
*Acting Director of the United States Patent and Trademark Office*